US011322058B2

(12) United States Patent
Nakatsuka et al.

(10) Patent No.: US 11,322,058 B2
(45) Date of Patent: May 3, 2022

(54) DEVICE MANAGEMENT APPARATUS, DEVICE MANAGING METHOD, AND PROGRAM

(71) Applicant: SONY CORPORATION, Tokyo (JP)

(72) Inventors: Shigeo Nakatsuka, Tokyo (JP); Yasuhiro Iizuka, Kanagawa (JP); Kazuhiro Uchida, Kanagawa (JP); Tetsuo Kaneko, Kanagawa (JP); Shinnosuke Usami, Tokyo (JP)

(73) Assignee: SONY CORPORATION, Tokyo (JP)

( * ) Notice: Subject to any disclaimer, the term of this patent is extended or adjusted under 35 U.S.C. 154(b) by 269 days.

(21) Appl. No.: 16/072,675

(22) PCT Filed: Jan. 6, 2017

(86) PCT No.: PCT/JP2017/000253
§ 371 (c)(1),
(2) Date: Jul. 25, 2018

(87) PCT Pub. No.: WO2017/145525
PCT Pub. Date: Aug. 31, 2017

(65) Prior Publication Data

US 2019/0043398 A1 Feb. 7, 2019

(30) Foreign Application Priority Data

Feb. 23, 2016 (JP) ..... JP2016-031851

(51) Int. Cl.
*G09G 3/00* (2006.01)
*G09G 3/36* (2006.01)
(Continued)

(52) U.S. Cl.
CPC ..... *G09G 3/006* (2013.01); *G09G 3/32* (2013.01); *G09G 3/3406* (2013.01); *G09G 3/36* (2013.01);
(Continued)

(58) Field of Classification Search
CPC ..... G09G 3/006; G09G 3/32; G09G 3/3406; G09G 3/36; G09G 2370/022; G09G 2370/16
(Continued)

(56) References Cited

U.S. PATENT DOCUMENTS 7,212,024 B2 * 5/2007 Iwasaki ..... G09G 3/006 324/759.03
2004/0141131 A1 * 7/2004 Ishikawa ..... G09G 3/006 349/139
(Continued)

FOREIGN PATENT DOCUMENTS

JP 2005-259429 A 9/2005
JP 2006-156286 A 6/2006
JP 2013-3472 A 1/2013

OTHER PUBLICATIONS

Seiji et al.; Translation of JP 2013003472 A; Pub. Date Jan. 7, 2013; Translated by EPO & Google (Year: 2013).*
(Continued)

*Primary Examiner* — Judy Nguyen
*Assistant Examiner* — Rahul Maini
(74) *Attorney, Agent, or Firm* — Oblon, McClelland, Maier & Neustadt, L.L.P.

(57) ABSTRACT

A device management apparatus 31 communicates with a plurality of devices to be managed. When an imaging apparatus in which abnormality occurs is detected, or in a case where any imaging apparatus is specified by a user from the imaging apparatuses in which the abnormality occurs, the device management apparatus 31 communicates with the imaging apparatus located within a specific range based on a position of the detected imaging apparatus in which the abnormality occurs or the imaging apparatus in which the abnormality occurs specified by the user, and performs the device specification display using a display unit of the
(Continued)

imaging apparatus located within the specific range. By referring to the device specification display, the user may easily specify a desired device, for example, the device in which the abnormality occurs from a plurality of devices.

16 Claims, 15 Drawing Sheets

(51) Int. Cl.
*G09G 3/32* (2016.01)
*G09G 3/34* (2006.01)

(52) U.S. Cl.
CPC ... *G09G 2370/022* (2013.01); *G09G 2370/16* (2013.01)

(58) Field of Classification Search
USPC ..... 324/760.01
See application file for complete search history.

(56) References Cited

U.S. PATENT DOCUMENTS

2008/0297628 A1* 12/2008 Kimura ..... H04N 9/30 348/246
2010/0049454 A1* 2/2010 Irissou ..... H05B 45/58 324/414
2012/0007898 A1* 1/2012 Pavicic ..... G09G 3/32 345/690

OTHER PUBLICATIONS

Yoshinobu et al.; Translation of JP 2006156286 A; Pub. Date Jun. 15, 2006; Translated by EPO & Google (Year: 2006).*
International Search Report dated Mar. 21, 2017 in PCT/JP2017/000253, 1 page.

* cited by examiner

FIG. 8

| IMAGING APPARATUS ID | POSITION | ISO | (INFORMATION 1) |
|---|---|---|---|
| cam0 | 0 | 1000 | xxx |
| cam1 | 1 | 1000 | xxx |
| cam2 | 2 | 1000 | xxx |
| cam3 | 3 | 1000 | xxx |
| cam4 | 4 | 1000 | xxx |
| cam5 | 5 | 1000 | xxx |
| cam6 | 6 | 1000 | xxx |
| cam7 | 7 | 1000 | xxx |
| cam8 | 8 | 1000 | xxx |
| cam9 | 9 | 1000 | xxx |

FIG. 9

| IMAGING APPARATUS ID | POSITION | ISO | (INFORMATION 1) |
|---|---|---|---|
| cam0 | | 1000 | xxx |
| cam1 | | 1000 | xxx |
| cam2 | | 1000 | xxx |
| cam3 | | 1000 | xxx |
| cam4 | | 1000 | xxx |
| cam5 | | 1000 | xxx |
| cam6 | | 1000 | xxx |
| cam7 | | 1000 | xxx |
| cam8 | | 1000 | xxx |
| cam9 | | 1000 | xxx |

POSITION AUTOMATIC ACQUISITION — BTp (a)

| IMAGING APPARATUS ID | POSITION | ISO | (INFORMATION 1) |
|---|---|---|---|
| cam0 | 0 | 1000 | xxx |
| cam1 | 1 | 1000 | xxx |
| cam2 | 2 | 1000 | xxx |
| cam3 | 3 | 1000 | xxx |
| cam4 | 4 | 1000 | xxx |
| cam5 | 5 | 1000 | xxx |
| cam6 | 6 | 1000 | xxx |
| cam7 | 7 | 1000 | xxx |
| cam8 | 8 | 1000 | xxx |
| cam9 | 9 | 1000 | xxx |

POSITION AUTOMATIC ACQUISITION — BTp (b)

FIG. 11

| IMAGING APPARATUS ID | POSITION | ISO | (INFORMATION 1) |
|---|---|---|---|
| cam0 | 0 | 1000 | xxx |
| cam1 | 1 | 1000 | xxx |
| cam2 | 2 | 1000 | xxx |
| cam3 | 3 | NO RESPONSE | NO RESPONSE |
| cam4 | 4 | 1000 | xxx |
| cam5 | 5 | 1000 | xxx |
| cam6 | 6 | 1000 | xxx |
| cam7 | 7 | 1000 | xxx |
| cam8 | 8 | 1000 | xxx |
| cam9 | 9 | 1000 | xxx |

FIG. 13

CUR

| IMAGING APPARATUS ID | POSITION | ISO | (INFORMATION 1) |
|---|---|---|---|
| cam0 | 0 | 1000 | xxx |
| cam1 | 1 | 1000 | xxx |
| cam2 | 2 | 1000 | xxx |
| cam3 | 3 | NO RESPONSE | NO RESPONSE |
| cam4 | 4 | 1000 | xxx |
| cam5 | 5 | 1000 | xxx |
| cam6 | 6 | 1000 | xxx |
| cam7 | 7 | 1000 | xxx |
| cam8 | 8 | 1000 | xxx |
| cam9 | 9 | 1000 | xxx |

Gmn

XXXX(F)
XXXX(O)
ABNORMAL DEVICE SPECIFICATION OPERATION (S)

(a)

CUR

| IMAGING APPARATUS ID | POSITION | ISO | (INFORMATION 1) |
|---|---|---|---|
| cam0 | 0 | 1000 | xxx |
| cam1 | 1 | 1000 | xxx |
| cam2 | 2 | 1000 | xxx |
| cam3 | 3 | NO RESPONSE | NO RESPONSE |
| cam4 | 4 | 1000 | xxx |
| cam5 | 5 | 1000 | xxx |
| cam6 | 6 | 1000 | xxx |
| cam7 | 7 | 1000 | xxx |
| cam8 | 8 | 1000 | xxx |
| cam9 | 9 | 1000 | xxx |

(b)

FIG. 14

| IMAGING APPARATUS ID | POSITION | SEARCH | ISO | (INFORMATION 1) |
|---|---|---|---|---|
| cam0 | 0 | EXECUTE | 1000 | xxx |
| cam1 | 1 | EXECUTE | 1000 | xxx |
| cam2 | 2 | EXECUTE | 1000 | xxx |
| cam3 | 3 | EXECUTE | NO RESPONSE | NO RESPONSE |
| cam4 | 4 | EXECUTE | 1000 | xxx |
| cam5 | 5 | EXECUTE | 1000 | xxx |
| cam6 | 6 | EXECUTE | 1000 | xxx |
| cam7 | 7 | EXECUTE | 1000 | xxx |
| cam8 | 8 | EXECUTE | 1000 | xxx |
| cam9 | 9 | EXECUTE | 1000 | xxx |

DEVICE MANAGEMENT APPARATUS, DEVICE MANAGING METHOD, AND PROGRAM

TECHNICAL FIELD

This technology relates to a device management apparatus, a device managing method, and a program, and makes it possible to easily specify a desired device from a plurality of devices.

BACKGROUND ART

A technology of specifying a device in which abnormality occurs in a system using a plurality of devices is conventionally disclosed. For example, in Patent Document 1, a camera image is detected from image screens shot by a plurality of cameras having different appearance features, and the camera which is shot is identified by the appearance features of the camera image. Furthermore, a position of the shot camera is calculated from the image screens of the two cameras which shoot the same shot camera which is detected, and in a case where an installation position calculated last time is different from the installation position calculated this time, it is determined that abnormality in the installation position occurs.

CITATION LIST

Patent Document

Patent Document 1: Japanese Patent Application Laid-Open No. 2011-076573

SUMMARY OF THE INVENTION

Problems to be Solved by the Invention

There also is a case in which a plurality of devices forming the system has the same appearance. For example, in a three-dimensional modeling system, model data is generated by using a plurality of imaging apparatuses having the same appearance and the like. In this manner, if the appearance of a plurality of devices forming the system is the same, it is not possible to specify a desired imaging apparatus, for example, the imaging apparatus in which abnormality occurs by using the appearance feature.

Therefore, an object of this technology is to provide a device management apparatus, a device managing method, and a program capable of easily specifying the desired device from a plurality of devices.

Solutions to Problems

A first aspect of the present technology is a device management apparatus provided with:

a communication unit which communicates with a plurality of devices to be managed; and a control unit which discriminates a device located within a specific range based on a position of a device in which abnormality occurs to communicate with the device located within the specific range, and performs device specification display by using a display unit of the device located within the specific range.

In this technology, communication is performed between the device management apparatus and a plurality of devices to be managed via a network or the like. The control unit of the device management apparatus discriminates the device located within the specific range based on the position of the device in which the abnormality occurs on the basis of the positions of a plurality of devices when detecting the device in which the abnormality occurs on the basis of the communication with each device, for example. Furthermore, the control unit performs the device specification display by performing lighting control of the display unit of the discriminated device located within the specific range. Also, in a case where there is a plurality of devices in which the abnormality occurs and the devices within the specific range based on the position of the device in which the abnormality occurs overlap with each other, the control unit selects the device so that the specific range does not overlap from a plurality of devices in which the abnormality occurs the specific ranges of which overlap with each other. The control unit performs the device specification display using the display unit of the device located within the specific range based on the position of the selected device.

Also, the device management apparatus is provided with the display unit for displaying a list of management information of a plurality of devices and a user interface unit for accepting user operations. The control unit makes the device in which the abnormality occurs in the list display identifiable and performs the device specification display when determining that a specification operation of the device in which the abnormality occurs is performed by the user interface unit. Also, the control unit displays a list of the management information of a plurality of devices on the display unit in a list form, and includes the device identification information in the list display. Also, the control unit displays a list of the management information of a plurality of devices on the display unit in a graphic form, and arranges icons representing the devices on the basis of the positions of the devices. Also, the device identification information is added to the icon representing the device. Furthermore, the control unit displays a list of the devices located within the specific range based on the position of the device in which the abnormality occurs so as to be identifiable. Herein, in a case where there is a plurality of devices in which the abnormality occurs, a display attribute regarding the device located within the specific range in the list display is changed for each device in which the abnormality occurs.

A second aspect of the present technology is a device managing method provided with:

communicating with a plurality of devices to be managed by a communication unit; and discriminating a device located within a specific range based on a position of a device in which abnormality occurs to communicate with the device located within the specific range through the communication unit, and performing device specification display by using a display unit of the device located within the specific range by the control unit.

A third aspect of the present technology is a program for allowing a computer to execute management of a device, the program for allowing the computer to realize:

a discrimination function of discriminating a device located within a specific range based on a position of a device in which abnormality occurs, and a display function of communicating with the device located within the specific range via a communication unit and performing device specific display using a display unit of the device located within the specific range.

Meanwhile, the program of the present technology is the program which may be provided by a storage medium and a communication medium provided in a computer-readable form, for example, a storage medium such as an optical disk, a magnetic disk, and a semiconductor memory, or a communication medium such as a network to a general-purpose computer capable of executing various program codes, for example. By providing such program in the computer-readable form, processing according to the program is realized on the computer.

Effects of the Invention

According to this technology, the communication unit communicates with a plurality of devices to be managed. The control unit discriminates the device located within the specific range based on the position of the device in which the abnormality occurs to communicate with the device located within the specific range, and performs the device specification display by using the display unit of the device located within the specific range. Therefore, it is possible to easily specify a desired device, for example, a device in which the abnormality occurs from a plurality of devices on the basis of the device specification display. Meanwhile, the effect described in this specification is illustrative only; the effect is not limited thereto and there may also be an additional effect.

BRIEF DESCRIPTION OF DRAWINGS

FIG. 8 is a view illustrating a list display illustrating a position of the imaging apparatus.

FIG. 9 is a view illustrating the list display in a case where a function of automatically acquiring the position of the imaging apparatus is provided.

FIG. 11 is a view illustrating a list display including the imaging apparatus in which abnormality occurs.

FIG. 13 is a view illustrating a specification operation of the imaging apparatus in which the abnormality occurs (case of the list display).

FIG. 14 is a view illustrating the specification operation of the imaging apparatus in which the abnormality occurs (case of the list display).

MODE FOR CARRYING OUT THE INVENTION

Hereinafter, a mode for carrying out the present technology is described. Meanwhile, the description is given in the following order.

1. Configuration of System
2. First Operation
3. Second Operation
4. Other Operations <1. Configuration of System>

Figure 1:
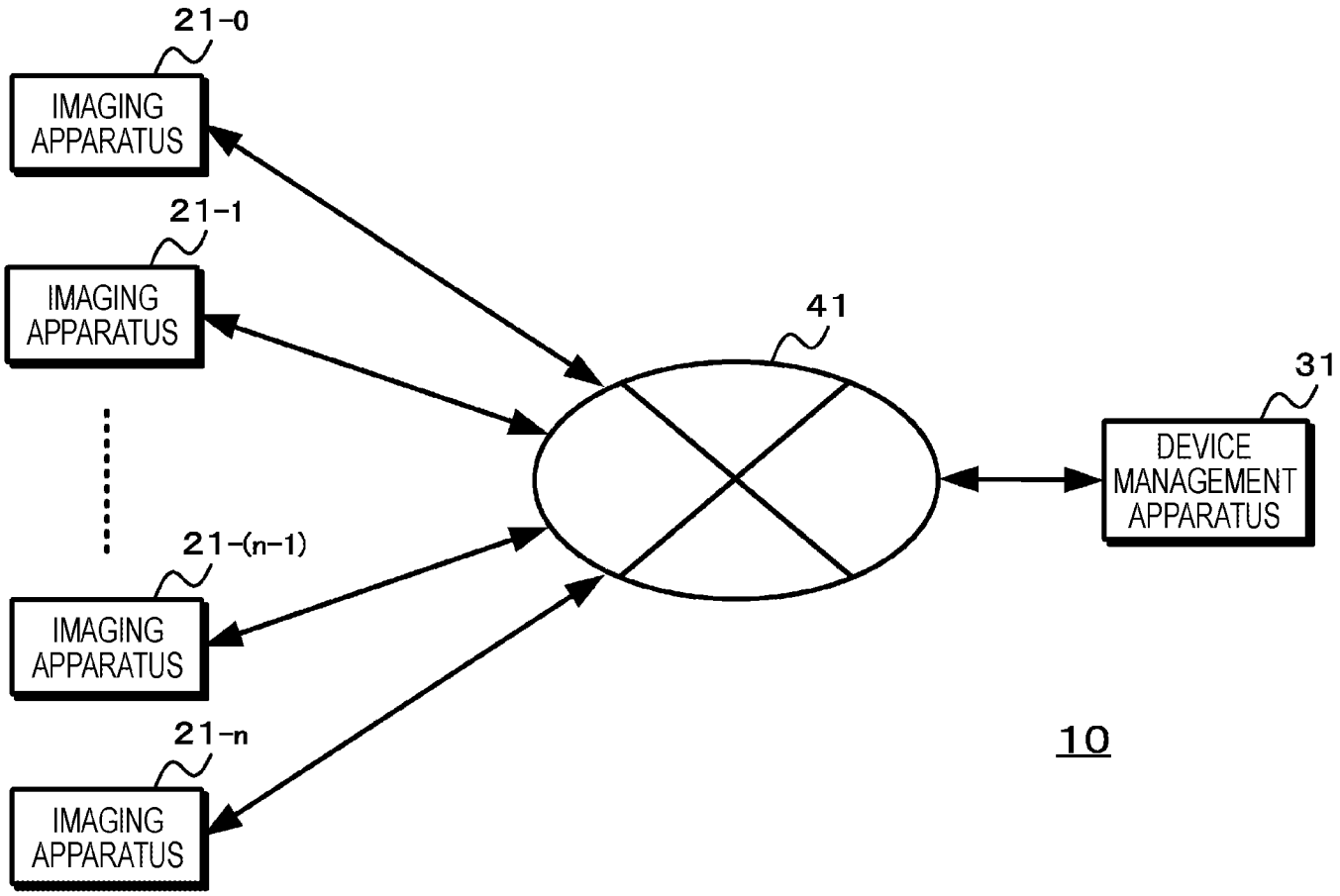
FIG. 1 is a view illustrating a configuration of a system using a device management apparatus.

FIG. 1 illustrates a configuration of a system using a device management apparatus of the present technology. In a system 10, a plurality of imaging apparatuses 21-0 to **21-*n* is connected to a device management apparatus 31 via a network 41**.

Figure 2:
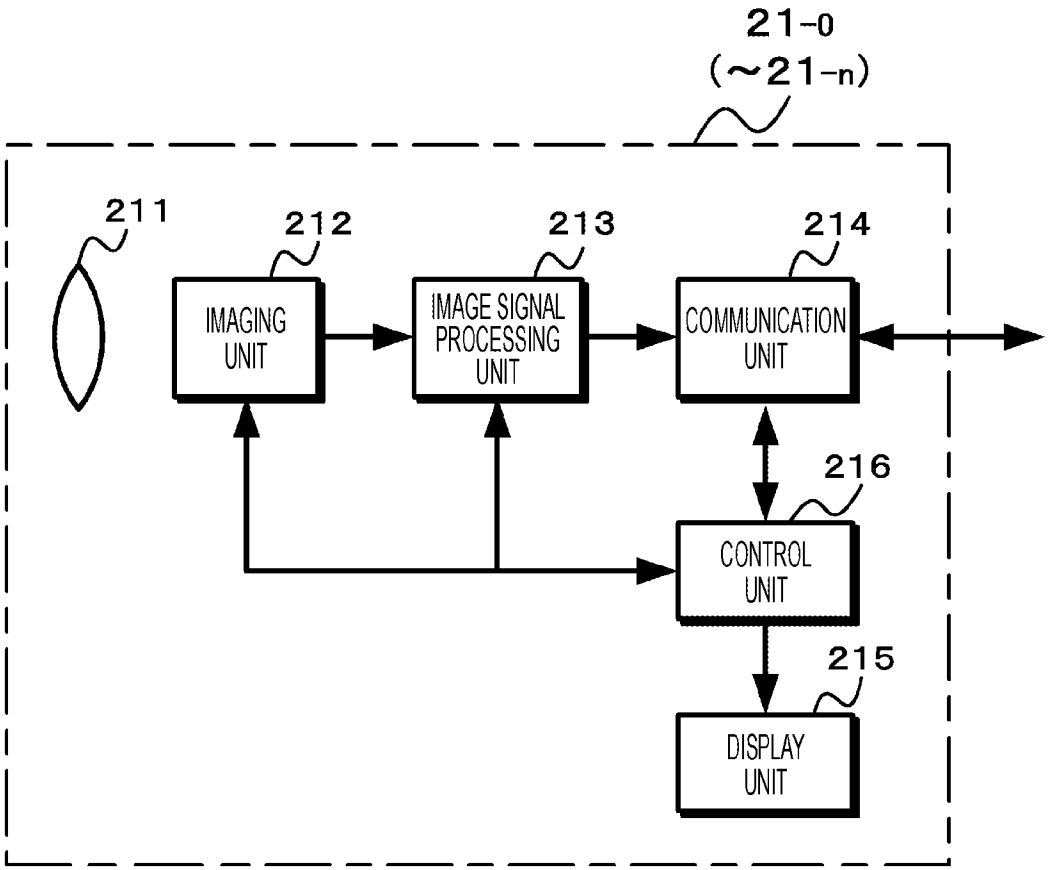
FIG. 2 is a view illustrating a configuration of an imaging apparatus.

FIG. 2 illustrates a configuration of the imaging apparatus. The imaging apparatus 21-0 includes an imaging lens 211, an imaging unit 212, an image signal processing unit 213, a communication unit 214, a display unit 215, and a control unit 216.

The imaging lens 211 formed by using a focus lens or the like forms a subject optical image on an imaging surface of the imaging unit 212.

The imaging unit 212 is formed by using a complementary metal oxide semiconductor (CMOS) image sensor, a charge coupled device (CCD) image sensor or the like. The imaging unit 212 performs photoelectric conversion, generates an image signal corresponding to the subject optical image, and outputs the same to the image signal processing unit 213.

The image signal processing unit 213 performs noise removal processing, pixel defect correction, and camera signal processing such as brightness adjustment and white balance adjustment, for example, on the image signal generated by the imaging unit 212. The image signal processing unit 213 outputs the image signal after the signal processing to the communication unit 214.

The communication unit 214 communicates with the device management apparatus 31 via the network 41, receives a control signal from the device management apparatus 31, and outputs the same to the control unit 216. In addition, the communication unit 214 transmits the image signal supplied from the image signal processing unit 213 to the device management apparatus 31. Meanwhile, the communication unit 214 may communicate by either wireless or wired communication.

The display unit 215 formed by using a light emitting element such as a light emitting diode is provided in a position of the imaging apparatus 21-0, for example, on a rear surface of a casing and the like which may be visually externally recognized even when the imaging apparatus 21-0 and other plurality of imaging apparatuses are arranged in desired positions. In the display unit 215, lighting driving of the light emitting element is performed on the basis of a driving signal from the control unit 216.

The control unit 216 controls an operation of each unit of the imaging apparatus 21-0 on the basis of the control signal from the device management apparatus 31 and performs an operation in response to an instruction of the device management apparatus 31. For example, the control unit 216 performs operation control of generating the image signal on the basis of the instruction from the device management apparatus 31 and transmitting the same to the device management apparatus 31. Also, the control unit 216 drives the display unit 215 on the basis of a device specification display signal from the device management apparatus 31.

The imaging apparatuses 21-1 to **21-*n* also configured in the manner similar to that of the imaging apparatus 21-0 control the operation of each unit on the basis of the control signal from the device management apparatus 31 and perform the operation in response to the instruction of the device management apparatus 31. The imaging apparatuses 21-1 to 21-*n* also drive the display unit 215 on the basis of the device specification display signal from the device management apparatus 31**.

As is described later, the device management apparatus 31 controls the display unit by supplying the device specification display signal to the imaging apparatus located within a specific range based on a position of the device in which abnormality occurs. The device management apparatus 31 performs device specification display by using the display unit of the imaging apparatus located within the specific range so that a user may easily specify the imaging apparatus in which the abnormality occurs by controlling the display unit with the device specification display signal.

Figure 3:
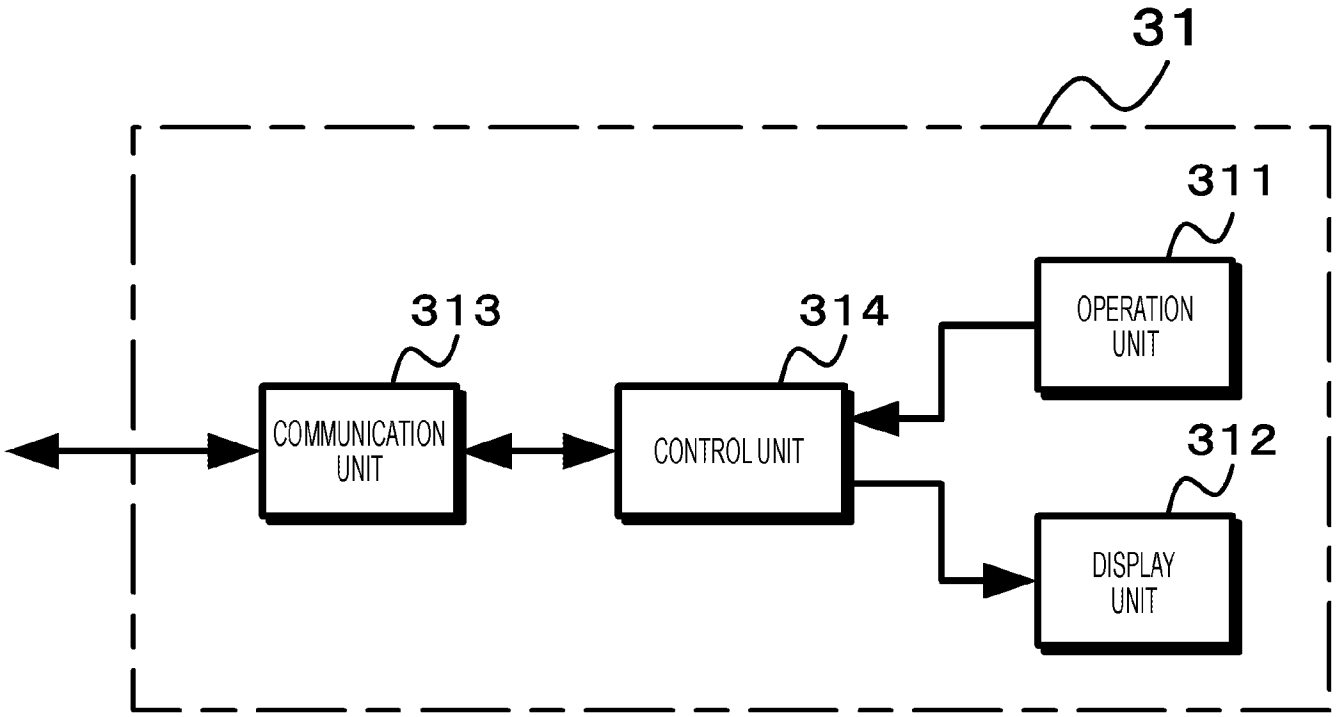
FIG. 3 is a view illustrating a configuration of the device management apparatus.

FIG. 3 illustrates a configuration of the device management apparatus. The device management apparatus 31 includes an operation unit 311, a display unit 312, a communication unit 313, and a control unit 314.

The operation unit (user interface unit) 311 formed by using a touch panel, an operation switch and the like generates an operation signal corresponding to a user operation and outputs the same to the control unit 314.

The display unit 312 is formed by using a liquid crystal display element and an organic EL display element. On the basis of the display signal from the control unit 314, the display unit 312 displays a menu, information acquired via a network, information of the imaging apparatus in which a problem occurs and the like.

The communication unit 313 communicates with the imaging apparatuses 21-0 to **21-*n* via the network 41 and transmits the control signal generated by the control unit 314 to the imaging apparatuses 21-0 to 21-*n*. Also, the communication unit 313 outputs the image signals supplied from the imaging apparatuses 21 to 21-*n* to the control unit 314. Meanwhile, the communication unit 313** may communicate by either wireless or wired communication.

On the basis of the operation signal from the operation unit 311, the control unit 314 generates the control signal so that the operation desired by the user is performed by the imaging apparatuses 21-0 to **21-*n*, and allows the communication unit 313 to output the same to the imaging apparatuses 21-0 to 21-*n*. Also, the control unit 314 performs various processes, for example, three-dimensional modeling and the like using the image signals transmitted from the imaging apparatuses 21-0 to 21-*n*. Furthermore, the control unit 314 monitors the operations of the imaging apparatuses 21-0 to 21-*n*, and when detecting the imaging apparatus in which the abnormality occurs, this transmits the device specification display signal to the imaging apparatus located within the specific range based on the position of the imaging apparatus in which the abnormality occurs. Also, when the imaging apparatus in which the abnormality occurs is specified, the control unit 314 transmits the device specification display signal to the imaging apparatus located within the specific range based on the position of the specified imaging apparatus. The control unit 314 controls the display unit of the imaging apparatus located within the specific range by transmitting the device specification display signal to perform the device specification display. Meanwhile, the device management apparatus 31 may have a configuration in which the operation unit 311 and the display unit 312** are separately provided.

<2. First Operation>

Figure 4:
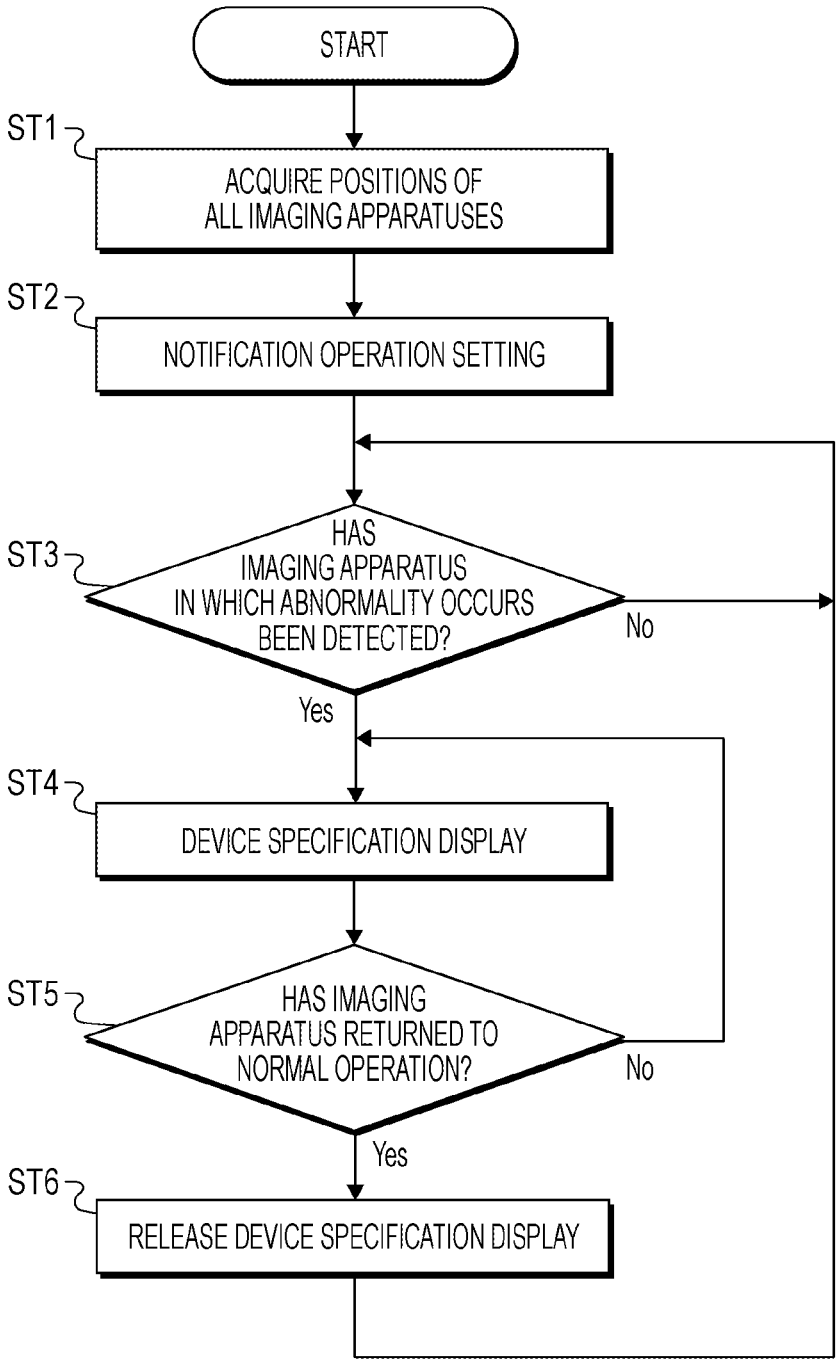
FIG. 4 is a flowchart illustrating a first operation.

FIG. 4 is a flowchart illustrating a first operation when the abnormality is detected in the device management apparatus.

At step ST1, the device management apparatus 31 acquires positions of all the imaging apparatuses. The device management apparatus 31 acquires absolute positions or relative positions of the imaging apparatuses 21-0 to **21-*n* so that a positional relationship among the imaging apparatuses 21-0 to 21-*n* may be grasped. For example, installation positions of the imaging apparatuses are specified in advance, and the imaging apparatuses 21-0 to 21-*n* are sequentially installed in the specified positions. In this manner, the positions of the imaging apparatuses 21-0 to 21-*n* may be acquired on the basis of the specified installation positions. Alternatively, it is also possible to provide a function of acquiring a current position on the imaging apparatuses 21-0 to 21-*n*, thereby acquiring the current positions from the imaging apparatuses 21-0 to 21-*n*. Furthermore, it is also possible that connection units to other imaging apparatuses are provided on upper, lower, left, and right sides of the imaging apparatus, the imaging apparatuses discriminate the imaging apparatus connected to the connection unit, and the device management apparatus 31 acquires the relative positions from a connection relationship of the imaging apparatuses 21-0 to 21-*n*. Meanwhile, the imaging apparatuses are not limited to be installed in a one-dimensional direction, and may be installed in a two-dimensional direction or a three-dimensional direction. The device management apparatus 31 acquires the positions of all the imaging apparatuses and shifts to step ST2**.

At step ST2, the device management apparatus 31 performs notification operation setting. The device management apparatus 31 sets a shape of the specific range according to a display pattern of the device specification display so that the device specification display may be performed by using the display unit of the imaging apparatus located within the specific range based on the position of the imaging apparatus in which the abnormality occurs. The display pattern of the device specification display is a pattern capable of easily specifying the imaging apparatus in which the abnormality occurs serving as a reference. For example, in a case where the imaging apparatuses are arranged in the one-dimensional direction, the display pattern has a linear shape and the position of the imaging apparatus in which the abnormality occurs is set in a central position of the straight line. Also, in a case where the imaging apparatuses are arranged in the two-dimensional direction, the display pattern has a cross shape and the position of the imaging apparatus in which the abnormality occurs is set at an intersection of line segments in two directions. In addition, the display pattern may have a circular or rectangular shape, and the position of the imaging apparatus in which the abnormality occurs may be in a central position of the circle or the rectangle. The device management apparatus 31 sets the display pattern automatically set according to the arrangement of the imaging apparatuses or the display pattern specified by the user as the display pattern of the device specification display and shifts to step ST3.

At step ST3, the device management apparatus 31 determines whether the imaging apparatus in which the abnormality occurs is detected. In a case where the device management apparatus 31 detects the imaging apparatus from which requested information cannot be acquired even when the information from the imaging apparatus is requested, for example, in a case where this detects the imaging apparatus which does not transmit the image signal even when the imaging apparatus is instructed to generate and transmit the image signal, this determines that the imaging apparatus in which the abnormality occurs is detected. Also, in a case where notification indicating that the operation in response to the instruction from the device management apparatus 31 cannot be performed is transmitted from the imaging apparatus by self-diagnosis or the like of the imaging apparatus, the device management apparatus 31 determines that the imaging apparatus in which the abnormality occurs is detected. In a case where the device management apparatus 31 detects the imaging apparatus in which the abnormality occurs, this shifts to step ST4, and in a case where this does not detect the imaging apparatus in which the abnormality occurs, this returns to step ST3.

At step ST4, the device management apparatus 31 performs the device specification display. On the basis of the position of the imaging apparatus acquired at step ST1, the device management apparatus 31 discriminates the imaging apparatus within the specific range set at step ST2 based on the position of the imaging apparatus determined to have the abnormality at step ST3. Furthermore, the device management apparatus 31 transmits a discrimination display signal for lighting up the display unit to the discriminated imaging apparatus. At that time, the imaging apparatus which receives the discrimination display signal generates the driving signal on the basis of the discrimination display signal to light up the display unit.

Figure 5:
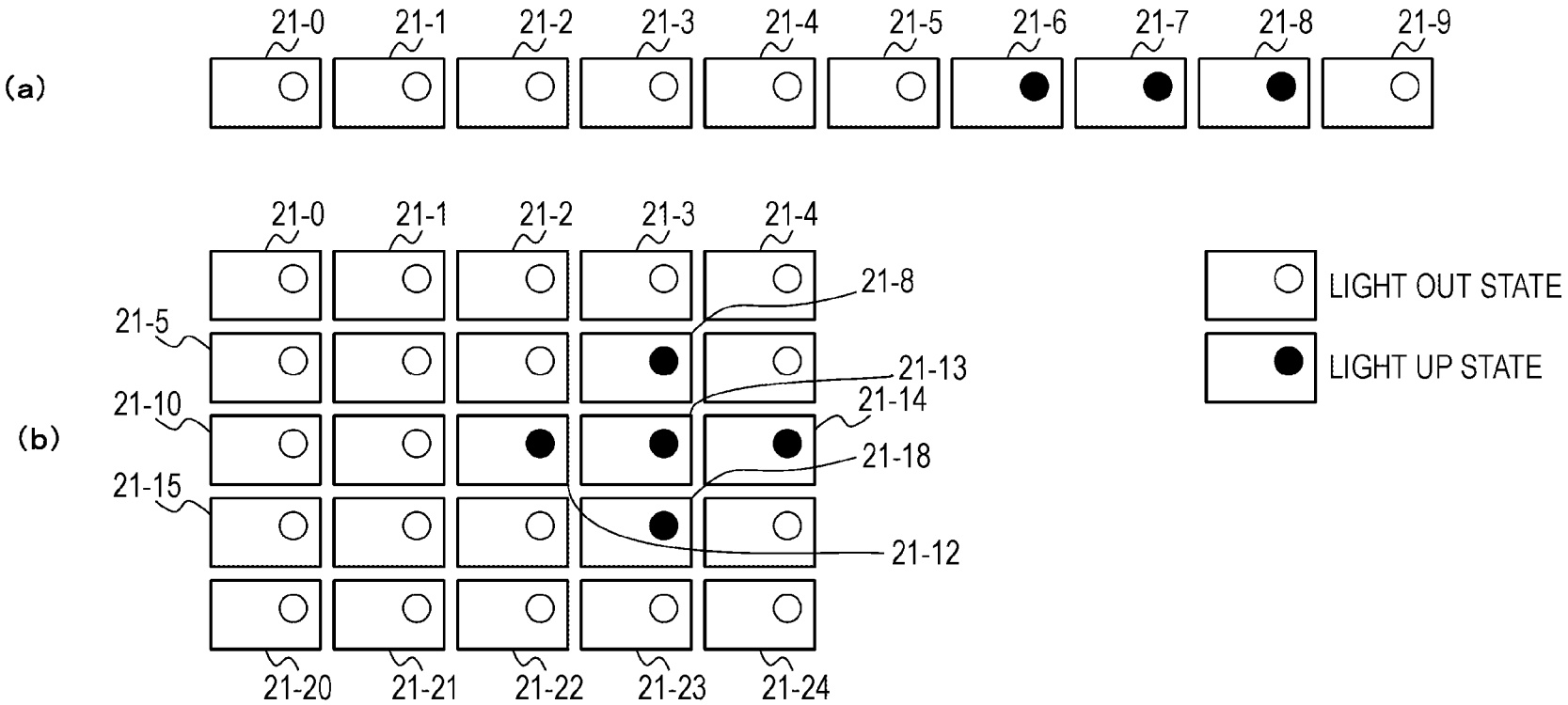
FIG. 5 is a view illustrating a device specification display.

FIG. 5 illustrates the device specification display, in which (a) of FIG. 5 illustrates a case where a plurality of imaging apparatuses is installed in the one-dimensional direction. Meanwhile, the device specification display is set to the linear display pattern in which the position of the imaging apparatus in which the abnormality occurs is in the central position of the straight line. In this case, when the abnormality occurs in the imaging apparatus 21-7, for example, the device management apparatus 31 performs the device specification display by lighting up the display units of the imaging apparatus 21-7 and the imaging apparatuses 21-6 and 21-8 located to the left and right of the imaging apparatus 21-7.

A case where a plurality of imaging apparatuses is installed in the two-dimensional direction is illustrated in (b) of FIG. 5. Meanwhile, the device specification display is set to the cross-shaped display pattern in which the position of the imaging apparatus in which the abnormality occurs is at the intersection of the line segments in the two directions. In this case, when the abnormality occurs in the imaging apparatus 21-13, for example, the device management apparatus 31 performs the device specification display by lighting up the display units of the imaging apparatus 21-13 and the imaging apparatuses 21-8, 21-12, 21-13, 21-14, and 21-18 located above and below and to the left and right of the imaging apparatus 21-13.

By performing the device specification display in this manner, it is possible to easily visually recognize the device specification display from a distant position as compared with a case where only the display unit of the imaging apparatus 21-7 in which the abnormality occurs is lit up, for example. Furthermore, it is possible to easily specify the imaging apparatus in which the abnormality occurs on the basis of the device specification display.

The device management apparatus 31 performs the device specification display based on the position of the imaging apparatus determined to have the abnormality using the display units of a plurality of imaging apparatuses, and shifts to step ST5.

At step ST5, the device management apparatus 31 determines whether it returns to normal operation. In a case where the imaging apparatus in which the abnormality occurs returns to the normal operation, for example, in a case where a service such as repair and replacement is performed on the imaging apparatus in which the abnormality occurs which may be specified easily by the device specification display and this returns to the normal operation, the device management apparatus 31 shifts to step ST6. Also, in a case where the service or the like is not performed and an abnormal state continues, the device management apparatus 31 returns to step ST4 and continues the device specification display.

At step ST6, the device management apparatus 31 releases the device specification display. Since the imaging apparatus in which the abnormality occurs returns to the normal operation, the device management apparatus 31 finishes transmitting the discrimination display signal so as not to perform the device specification display and returns to step ST3.

Also, although the display pattern illustrated in FIG. 5 illustrates a case where lighting control of the display unit of the imaging apparatus in which the abnormality occurs may be performed, there also is a case where the lighting control of the display unit of the imaging apparatus in which the abnormality occurs cannot be performed. For example, when the abnormality occurs in a power supply, the communication unit, the control unit and the like of the imaging apparatus, the device management apparatus 31 cannot perform the lighting control of the display unit of the imaging apparatus in which the abnormality occurs. Therefore, the device management apparatus 31 may perform the device specification display so that the position of the imaging apparatus in which the abnormality occurs may be easily specified even in a case where this cannot control the imaging apparatus in which the abnormality occurs. Specifically, the device specification display is performed by using the display unit of the imaging apparatus located within the specific range based on the position of the imaging apparatus in which the abnormality occurs, the imaging apparatus other than the imaging apparatus in which the abnormality occurs.

Figure 6:
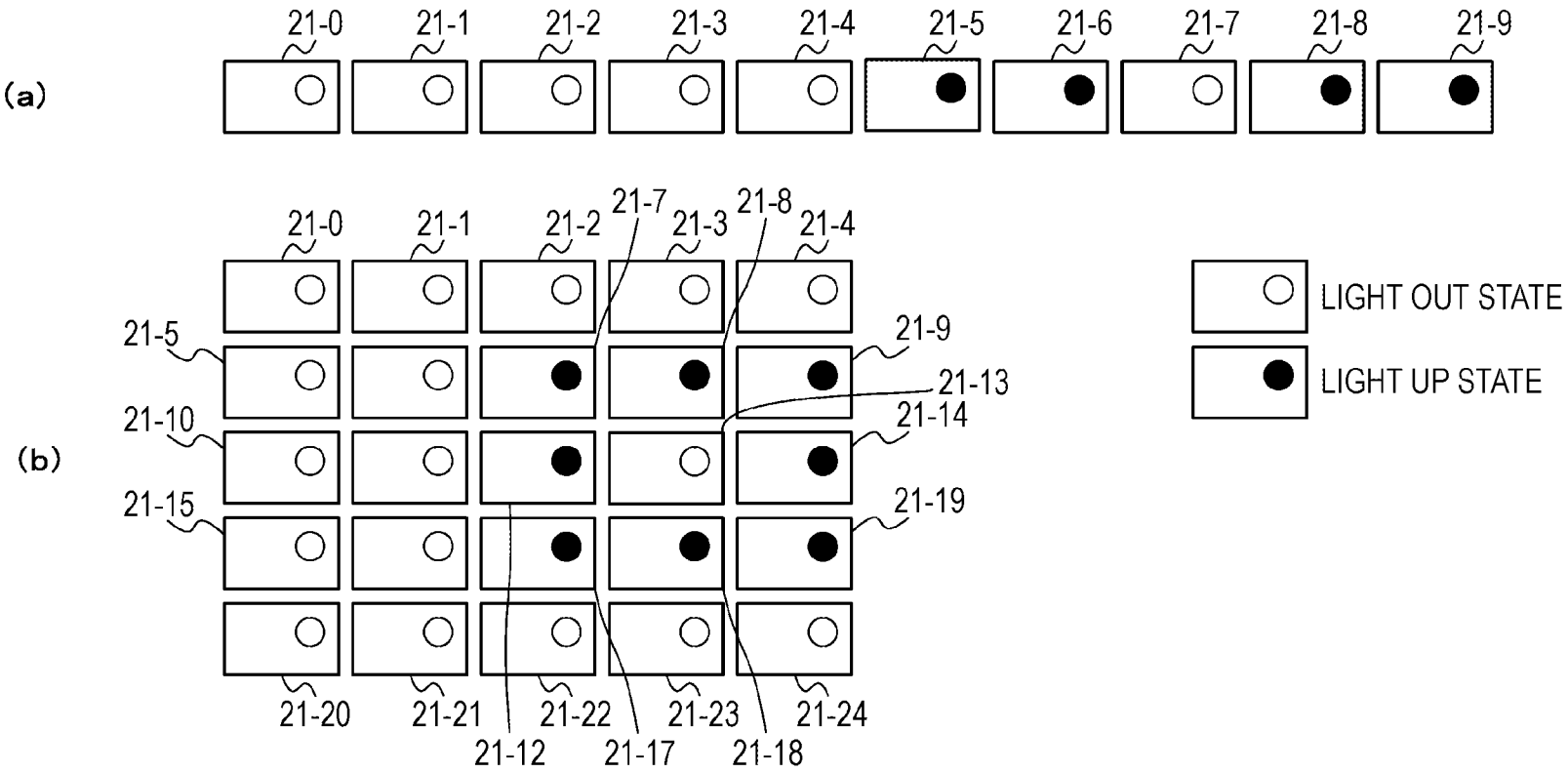
FIG. 6 is a view illustrating another example of the device specification display.

FIG. 6 illustrates a case where the display unit of the imaging apparatus in which the abnormality occurs cannot be controlled as another example of the device specification display. A case where a plurality of imaging apparatuses is installed in the one-dimensional direction is illustrated in (a) of FIG. 6. Meanwhile, the device specification display is set to the display pattern which is linear when the position of the imaging apparatus in which the abnormality occurs is skipped. In this case, when the abnormality occurs in the imaging apparatus 21-7, for example, the device management apparatus 31 performs the device specification display by lighting up the display units of the imaging apparatuses 21-5, 21-6, 21-6, and 21-9 located to the left and right of the imaging apparatus 21-7.

A case where a plurality of imaging apparatuses is installed in the two-dimensional direction is illustrated in (b) of FIG. 6. Meanwhile, the device specification display is set to a rectangular display pattern surrounding the position of the imaging apparatus in which the abnormality occurs. In this case, when the abnormality occurs in the imaging apparatus 21-13, for example, the device management apparatus 31 performs the device specification display by lighting up the display units of the imaging apparatuses 21-6, 21-7, 21-8, 21-12, 21-14, 21-17, 21-18, and 21-19 adjacent to the imaging apparatus 21-13.

By performing the device specification display in this manner, it is possible to easily visually recognize the device specification display from a distant position as compared with a case where only the display unit of the imaging apparatus 21-7 in which the abnormality occurs is lit up, for example. Furthermore, it is possible to easily specify the imaging apparatus in which the abnormality occurs on the basis of the device specification display. Also, it is possible to easily specify the imaging apparatus in which the abnormality occurs without using the display unit of the imaging apparatus in which the abnormality occurs.

As described above, when the imaging apparatus in which the abnormality occurs is detected, the device management apparatus performs the device specification display based on the position of the imaging apparatus in which the abnormality occurs by using the display units of a plurality of imaging apparatuses. Therefore, in a system in which a plurality of imaging apparatuses having similar appearances is used, in a case where the abnormality occurs in the imaging apparatus, it becomes possible to easily specify the imaging apparatus in which the abnormality occurs by using the device specification display. Therefore, it becomes possible to efficiently perform the service and the like on the imaging apparatus in which the abnormality occurs.

<3. Second Operation>

Next, a second operation is described. In the first operation described above, the case where the device specification display is automatically performed in response to the detection of the imaging apparatus in which the abnormality occurs is illustrated; however, in the second operation, a case where the device specification display is performed in response to the fact that the user specifies the imaging apparatus to which the service is performed is described.

Figure 7:
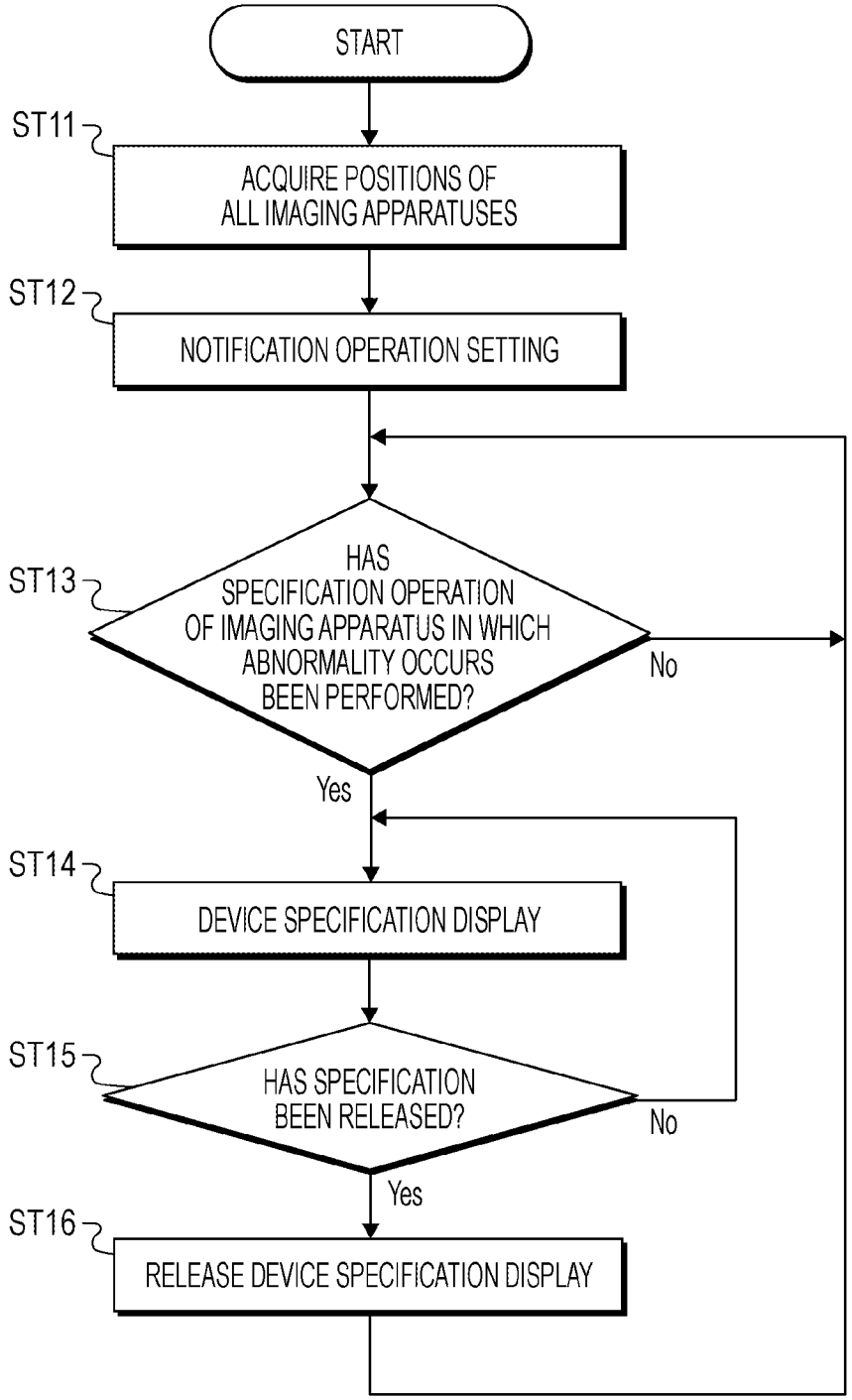
FIG. 7 is a flowchart illustrating a second operation.

FIG. 7 is a flowchart illustrating the second operation when the abnormality is detected in the device management apparatus.

At step ST11, the device management apparatus 31 acquires the positions of all the imaging apparatuses. As at step ST1, the device management apparatus 31 acquires the absolute positions or the relative positions of the imaging apparatuses 21-0 to **21-*n* so that the positional relationship among the imaging apparatuses 21-0 to 21-*n* may be grasped. For example, installation positions of the imaging apparatuses are specified in advance, and the imaging apparatuses 21-0 to 21-*n* are sequentially installed in the specified positions. In this manner, the positions of the imaging apparatuses 21-0 to 21-*n* may be acquired on the basis of the specified installation positions. Alternatively, it is also possible to provide a function of acquiring a current position on the imaging apparatuses 21-0 to 21-*n*, thereby acquiring the current positions from the imaging apparatuses 21-0 to 21-*n*. Furthermore, it is also possible that connection units to other imaging apparatuses are provided on upper, lower, left, and right sides of the imaging apparatus, the imaging apparatuses discriminate the imaging apparatus connected to the connection unit, and the device management apparatus 31 acquires the relative positions from a connection relationship of the imaging apparatuses 21-0 to 21-*n*. Meanwhile, the imaging apparatuses are not limited to be installed in a one-dimensional direction, and may be installed in a two-dimensional direction or a three-dimensional direction. The device management apparatus 31 acquires the positions of all the imaging apparatuses and displays information indicating the positions and the like of the imaging apparatuses on the display unit 312** so that the user may check the same.

FIG. 8 illustrates a list display illustrating the positions of the imaging apparatuses. In the list display, imaging apparatus identification information (hereinafter referred to as "imaging apparatus ID"), information indicating the position, information of ISO sensitivity, other information (for example, information 1) and the like are illustrated. The information of each item may be input by the user using the operation unit 311, or may be acquired from the imaging apparatus through communication with each imaging apparatus. Meanwhile, a case where ten imaging apparatuses are used is illustrated in FIG. 8.

FIG. 9 illustrates the list display in a case where a function of automatically acquiring the position of the imaging apparatus is provided. In the list display, the imaging apparatus ID, the information indicating the position, the information of the ISO sensitivity, other information (for example, information 1) and the like are illustrated. Also, on a lower end of the list display, a "position automatic acquisition" button BTp which is a command button for automatically acquiring the positional relationship of the imaging apparatuses is provided. The list display before acquiring the information indicating the position is illustrated in (a) of FIG. 9. When determining that the "position automatic acquisition" button BTp displayed on the display unit 312 is operated on the basis of the operation signal from the operation unit 311, the device management apparatus 31 acquires the position of the imaging apparatus and adds the information indicating the acquired position to the list. That is, the device management apparatus 31 updates the list display illustrated in (a) of FIG. 9 to the list display illustrated in (b) of FIG. 9 to which the information indicating the position is added.

Figure 10:
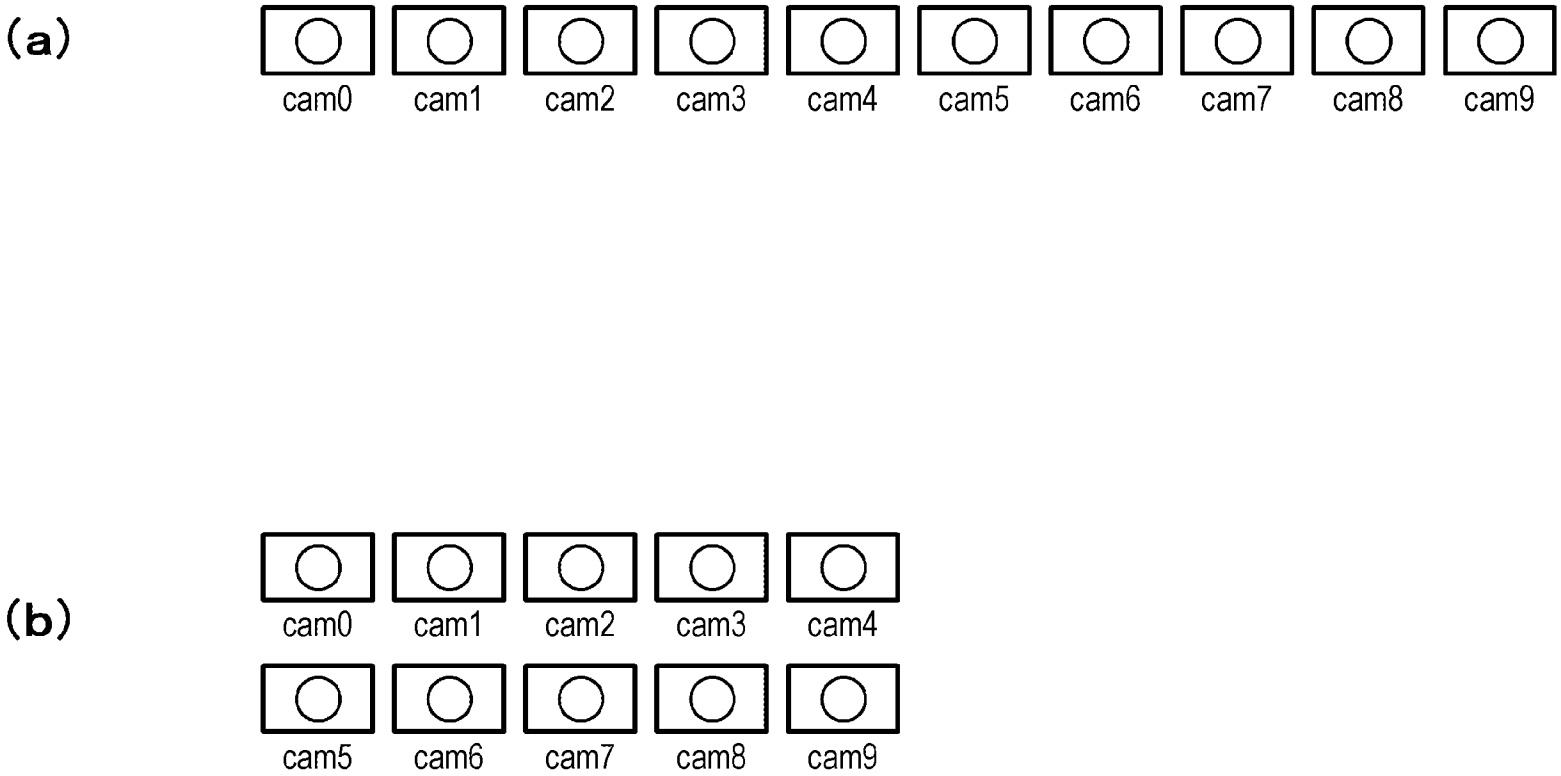
FIG. 10 is a view illustrating a graphic display illustrating the position of the imaging apparatus.

Also, the device management apparatus 31 may display the position of the imaging apparatus not only in a list form but also in a graphic form. FIG. 10 is a view illustrating a graphic display illustrating the positions of the imaging apparatuses. Meanwhile, a case where ten imaging apparatuses are arranged in the one-dimensional direction is illustrated in (a) of FIG. 10, and a case where the ten imaging apparatuses are arranged in the two-dimensional direction is illustrated in (b) of FIG. 10. In the graphic display, for example, an icon representing the imaging apparatus is provided corresponding to the position of the imaging apparatus. Also, the icon representing the imaging apparatus is with the imaging apparatus ID of the corresponding imaging apparatus. Therefore, it is possible to visually grasp the positions of a plurality of imaging apparatuses on the basis of icon arrangement and the imaging apparatus ID. Meanwhile, as the information of the ISO sensitivity, other information and the like, information regarding the imaging apparatus corresponding to the icon in a position of a cursor may be displayed when the cursor is put on the position of the icon representing the imaging apparatus using a function of a tooltip and the like.

The device management apparatus 31 acquires the positions of all the imaging apparatuses at step ST11, and then shifts to step ST12 to perform the notification operation setting. The device management apparatus 31 sets a shape of the specific range according to a display pattern of the device specification display so that the device specification display may be performed by using the display unit of the imaging apparatus located within the specific range based on the position of the imaging apparatus in which the abnormality occurs. The display pattern of the device specification display is a pattern capable of easily specifying the imaging apparatus in which the abnormality occurs serving as a reference. For example, in a case where the imaging apparatuses are arranged in the one-dimensional direction, the display pattern has a linear shape and the position of the imaging apparatus in which the abnormality occurs is set in a central position of the straight line. Also, in a case where the imaging apparatuses are arranged in the two-dimensional direction, the display pattern has a cross shape and the position of the imaging apparatus in which the abnormality occurs is set at an intersection of line segments in two directions. In addition, the display pattern may have a circular or rectangular shape, and the position of the imaging apparatus in which the abnormality occurs may be in a central position of the circle or the rectangle. The device management apparatus 31 sets the display pattern automatically set according to the arrangement of the imaging apparatuses or the display pattern specified by the user as the display pattern of the device specification display and shifts to step ST13.

Figure 12:
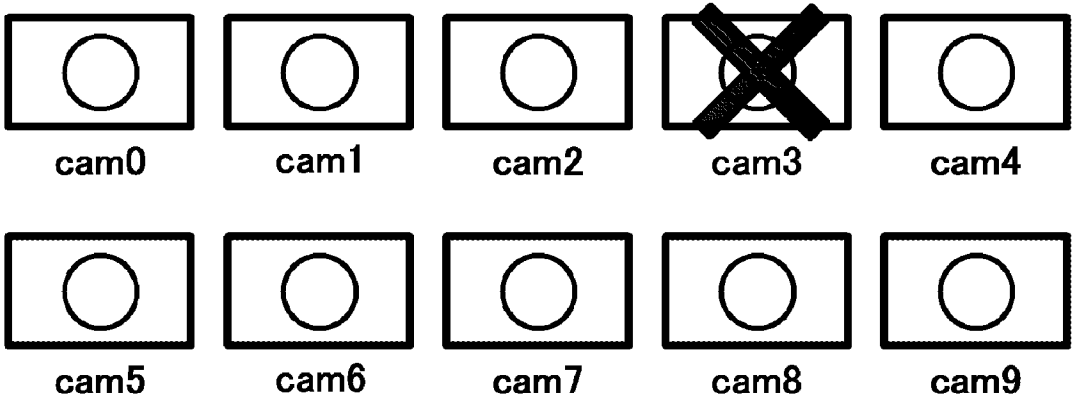
FIG. 12 is a view illustrating a graphic display including the imaging apparatus in which the abnormality occurs.

At step ST13, the device management apparatus 31 determines whether a specification operation of the imaging apparatus in which the abnormality occurs is performed. In a case where the device management apparatus 31 detects the imaging apparatus in which the abnormality occurs, for example, in a case where this detects the imaging apparatus from which the requested information cannot be acquired even when the information from the imaging apparatus is requested, this reflects a detection result in the list display or the graphic display. FIG. 11 illustrates the list display including the imaging apparatus in which the abnormality occurs, and FIG. 12 illustrates the graphic display including the imaging apparatus in which the abnormality occurs. In FIGS. 11 and 12, the abnormality occurs in the imaging apparatus the imaging apparatus ID of which is "cam3", and in the list display, "no response" indicating that the information of the ISO sensitivity, other information and the like are not acquired is displayed. Also, in the graphic display, a cross mark is put on the icon corresponding to the imaging apparatus in which the abnormality occurs. Meanwhile, the device management apparatus 31 may reflect, for example, the imaging apparatus which notifies that the operation in response to the instruction from the device management apparatus 31 cannot be performed in the list display and the graphic display as the imaging apparatus in which the abnormality occurs.

The device management apparatus 31 determines whether the specification operation of the imaging apparatus in which the abnormality occurs is performed on the basis of the list display or the graphic display. FIGS. 13 and 14 illustrate the specification operation of the imaging apparatus in which the abnormality occurs (case of the list display). As illustrated in (a) of FIG. 13, when the position of a cursor CUR is put on a list position of the imaging apparatus in which the abnormality occurs, for example, the list position of the imaging apparatus the imaging apparatus ID of which is "cam3", the device management apparatus 31 displays a menu Gmn. The device management apparatus 31 provides an item of "abnormal device specification operation" in the menu Gmn, and when this item is clicked, this determines that the specification operation of the imaging apparatus in which the abnormality occurs is performed. Also, as illustrated in (b) of FIG. 13, the device management apparatus 31 may determine that the specification operation of the imaging apparatus in which the abnormality occurs is performed when the click operation is performed in a state where the position of the cursor CUR is put on the list position of the imaging apparatus in which the abnormality occurs, for example, the position of the imaging apparatus ID of "cam3". Also, as illustrated in FIG. 14, the device management apparatus 31 may provide a search item for searching the device in which the abnormality occurs in the list display, and the device management apparatus 31 may search the imaging apparatus in which the abnormality occurs when an "execute" button of the search item is operated and automatically make the searched imaging apparatus the specified imaging apparatus.

Figure 15:
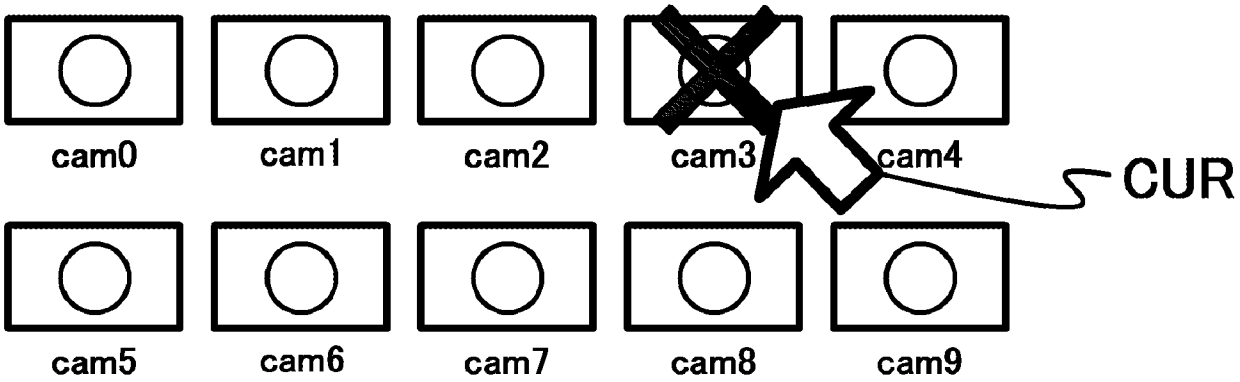
FIG. 15 is a view illustrating the specification operation of the imaging apparatus in which the abnormality occurs (case of the graphic display).

FIG. 15 illustrates the specification operation of the imaging apparatus in which the abnormality occurs (case of the graphic display). When the click operation is performed in a state in which the position of the cursor CUR is put on the icon position of the imaging apparatus in which the abnormality occurs, for example, the icon position of the imaging apparatus the imaging apparatus ID of which is "cam 3", the device management apparatus 31 determines that the specification operation of the imaging apparatus in which the abnormality occurs is performed.

The device management apparatus 31 determines whether the specification operation of the imaging apparatus in which the abnormality occurs is performed on the basis of the list display or the graphic display, and when this determines that the specification operation is performed, this shifts to step ST14, and when this does not determine that the specification operation is performed, this returns to step ST13.

At step ST14, the device management apparatus 31 performs the device specification display. On the basis of the position of the imaging apparatus acquired at step ST11, the device management apparatus 31 discriminates the imaging apparatus within the specific range set at step ST12 based on the position of the imaging apparatus specified at step ST13. Furthermore, the device management apparatus 31 transmits a discrimination display signal for lighting up the display unit to the discriminated imaging apparatus. At that time, the imaging apparatus which receives the discrimination display signal generates the driving signal on the basis of the discrimination display signal to light up the display unit. In this manner, the device management apparatus 31 performs the device specification display based on the position of the imaging apparatus determined to have the abnormality using the display units of the plurality of imaging apparatuses, and shifts to step ST15.

At step ST15, the device management apparatus 31 determines whether the specification is released. In a case where the imaging apparatus in which the abnormality occurs returns to the normal operation, the device management apparatus 31 reflects, in the list display and the graphic display, that this returns to the normal operation. For example, in a case where the service such as the repair and the replacement is performed on the imaging apparatus in which the abnormality occurs which may be specified easily by the device specification display, the device management apparatus 31 reflects the fact that the operation returns to the normal operation in the list display and the graphic display. Also, since the imaging apparatus in which the abnormality occurs returns to the normal operation, the device management apparatus 31 releases the specification as the imaging apparatus in which the abnormality occurs of the imaging apparatus which returns to the normal operation. Meanwhile, the specification may be released automatically by the device management apparatus 31 in response to the fact that the imaging apparatus in which the abnormality occurs returns to the normal operation or may be released in response to the user operation. In a case where it is determined that the specification is released, the device management apparatus 31 shifts to step ST16, and in a case where it is not determined that the specification is released, this returns to step ST14 and continues the device specification display.

At step ST16, the device management apparatus 31 releases the device specification display. Since the imaging apparatus in which the abnormality occurs returns to the normal operation, the device management apparatus 31 finishes transmitting the specification display signal so as not to perform the device specification display and returns to step ST13.

As described above, when the specification operation of the imaging apparatus in which the abnormality occurs is performed, the device management apparatus performs the device specification display based on the position of the imaging apparatus in which the abnormality occurs by using the display units of a plurality of imaging apparatuses. Therefore, in a system in which a plurality of imaging apparatuses having similar appearances is used, in a case where the abnormality occurs in the imaging apparatus, it becomes possible to easily specify the imaging apparatus in which the abnormality occurs by using the device specification display. Therefore, it becomes possible to efficiently perform the service and the like on the imaging apparatus in which the abnormality occurs.

<4. Other Operations>

It is also assumed that the abnormality occurs in a plurality of imaging apparatuses in a plurality of imaging apparatuses used in the system. Herein, in a case where the device specification display is performed on the basis of each of the imaging apparatuses in which the abnormality occurs, there is a case where the device specification display overlaps and it is difficult to specify the imaging apparatus in which the abnormality occurs. Therefore, the device management apparatus performs the device specification display by selecting the imaging apparatus in which the abnormality occurs so that the device specification display (specific range) of the display pattern selected by the user does not overlap, for example. For example, the device management apparatus switches to select the imaging apparatus in which the abnormality occurs in a predetermined time unit, and performs the device specification display based on the position of the selected imaging apparatus, thereby preventing display overlapping. Also, in a case where the list display or the graphic display is performed, the device management apparatus may display the imaging apparatus to be used in the device specification display so as to be discriminated for each imaging apparatus in which the abnormality occurs. In this case, the user may specify the imaging apparatus in which the abnormality occurs so that the device specification display does not overlap on the basis of the display of the imaging apparatus used for the device specification display for each imaging apparatus in which the abnormality occurs. For example, in the case of the list display, the imaging apparatus ID and the like of the imaging apparatus used in the device specification display of a first imaging apparatus in which the abnormality occurs is displayed with a first display attribute (color, background pattern and the like). Also, the imaging apparatus ID and the like of the imaging apparatus used in the device specification display of a second imaging apparatus in which the abnormality occurs is displayed with a second display attribute. In this manner, it is possible to refer to the display attribute such as the imaging apparatus ID and specify the imaging apparatus in which the abnormality occurs so that the device specification display does not overlap. Also, in the case of the graphic display, the icon of the imaging apparatus used in the device specification display of the first imaging apparatus in which the abnormality occurs is displayed with the first display attribute (color, background pattern and the like). Also, the icon of the imaging apparatus used in the device specification display of the second imaging apparatus in which the abnormality occurs is displayed with the second display attribute. Also, an area display representing the range of the imaging apparatus used in the device specification display may be performed for each imaging apparatus in which the abnormality occurs. In this manner, it is possible to refer to the display attribute of the icon and the area display and specify the imaging apparatus in which the abnormality occurs so that the device specification display does not overlap.

Also, although the case where the device management apparatus lights up the display unit to perform the device specification display is illustrated in the above-described embodiment, the device specification display may also be performed by lighting up/out the display unit repeatedly. For example, the device management apparatus sequentially switches the display units of the imaging apparatuses lit up in the imaging apparatuses within the specific range in a direction toward the imaging apparatus in which the abnormality occurs. By performing such device specification display, it is possible to more easily specify the imaging apparatus in which the abnormality occurs on the basis of a moving direction of the display unit to be lit.

Also, although the case where the imaging apparatus and the device management apparatus are separately provided is illustrated in the above-described embodiment, it is also possible to provide the function of the device management apparatus on any one of the plurality of imaging apparatuses to perform the above-described operation.

Also, although the case where the display unit formed by using the light emitting element such as the light emitting diode (LED) is provided on the imaging apparatus to perform the device specification display is illustrated in the above-described embodiment, the device specification display may also be performed by using illumination or the like provided on the imaging apparatus as the display unit. Also, in a case where an audio output unit is provided on the imaging apparatus, as in the case of the control of the display unit, an audio output from the audio output unit may be controlled so that the imaging apparatus in which the abnormality occurs is specified by using the audio output.

Furthermore, although the case where a plurality of devices is the imaging apparatuses is illustrated in the above-described embodiment, a plurality of devices is not limited to the imaging apparatuses. For example, when being applied to a case where a plurality of measuring instruments is arranged to acquire measured values at multi-point positions, when there is a measuring instrument which cannot acquire a correct measured value, a prompt restoring operation becomes possible, and measurement data missing and the like may be minimized. In addition, in a case where abnormality occurs in the display apparatus with a large screen display using a plurality of display apparatuses, it is not easy to detect the display apparatus which fails from a surface opposite to a display surface (rear surface side). However, if a display is provided on the rear surface and the device specification display is performed as described above, it is possible to easily detect the display apparatus in which the abnormality occurs from the rear surface side.

Also, although a case where the device having the abnormality is easily specified by the device specification display as a desired device is illustrated in the above-described embodiment, the device displayed by the device specification display is not limited to the device in which the abnormality occurs. For example, the device specification display may be performed in a case of specifying a desired device in which the abnormality does not occur. In this case, in a case where the desired device is specified by the user or the like from the list display or the graphic display, if the device management apparatus performs the device specification display on the basis of the position of the specified device, the desired device may be easily specified from a plurality of devices.

The series of processing described in the specification may be executed by hardware, software, or a composite configuration of both. In a case where the processing by the software is executed, a program in which a processing sequence is recorded is installed in a memory in a computer incorporated in dedicated hardware and executed. Alternatively, it is possible to install and execute the program in a general-purpose computer capable of executing various processes.

For example, the program may be recorded in advance in a hard disk, a solid state drive (SSD), and a read only memory (ROM) as a recording medium. Alternatively, the program may be temporarily or permanently stored (recorded) in a removable recording medium such as a flexible disk, a compact disc read only memory (CD-ROM), a magneto optical (MO) disk, a digital versatile disc (DVD), a Blu-ray Disc (BD) (registered trademark), a magnetic disk, a semiconductor memory and the like. Such removable recording medium may be provided as so-called package software.

In addition to be installed from the removable recording medium into the computer, the program may be transferred wirelessly or by wire from a download site to a computer via a network such as a local area network (LAN) or the Internet. In the computer, it is possible to receive the program transferred in this way and to install the same on a recording medium such as a built-in hard disk.

Meanwhile, the effect described in this specification is illustrative only and is not limited; there may be an additional effect not described. Also, the present technology should not be construed as being limited to the above-described embodiment of the technology. The embodiment of this technology discloses the present technology in the form of illustration, and it is obvious that those skilled in the art may modify and substitute the embodiment without departing from the gist of the present technology. That is, in order to determine the gist of the present technology, claims should be taken into consideration.

Also, the device management apparatus of the present technology may also have the following configuration.

(1) A device management apparatus provided with:

a communication unit which communicates with a plurality of devices to be managed; and a control unit which discriminates a device located within a specific range based on a position of a device in which abnormality occurs to communicate with the device located within the specific range, and performs device specification display by using a display unit of the device located within the specific range.

(2) The device management apparatus according to (1), in which the control unit performs lighting control of the display unit of the device located within the specific range to perform the device specification display.

(3) The device management apparatus according to (1) or (2), in which, in a case where there is a plurality of devices in which the abnormality occurs and specific ranges based on positions of the devices in which the abnormality occurs overlap with each other, the control unit selects the device such that the specific ranges do not overlap with each other from a plurality of devices in which the abnormality occurs the specific ranges of which overlap with each other, and performs the device specification display on the selected device.

(4) The device management apparatus according to any one of (1) to (3), in which the control unit performs the device specification display when detecting the device in which the abnormality occurs on the basis of the communication with the device.

(5) The device management apparatus according to (1) or (2), further provided with:

a display unit which displays a list of positions of the plurality of devices; and a user interface unit which accepts a user operation, in which the control unit displays the device in which the abnormality occurs so as to be identifiable in the list display and performs the device specification display when determining that a specification operation of the device in which the abnormality occurs is performed in the user interface unit.

(6) The device management apparatus according to (5), in which the control unit displays a list of the positions of the plurality of devices on the display unit in a list form, and includes device identification information individually set for the plurality of devices in the list display.

(7) The device management apparatus according to (5), in which the control unit displays a list of the positions of the plurality of devices on the display unit in a graphic form and arranges icons representing the devices on the basis of the positions.

(8) The device management apparatus according to (7), in which the control unit adds device identification information to the icons representing the devices to display.

(9) The device management apparatus according to any one of (5) to (8), in which the control unit displays the device located within the specific range based on the position of the device in which the abnormality occurs so as to be identifiable in the list display.

(10) The device management apparatus according to (9), in which, in a case where there is a plurality of devices in which the abnormality occurs, the control unit changes a display attribute regarding the device located within the specific range in the list display for each device in which the abnormality occurs.

INDUSTRIAL APPLICABILITY

In the device management apparatus, the device managing method, and the program in this technology, the communication unit communicates with a plurality of devices to be managed. The control unit discriminates the device located within the specific range based on the position of the device in which the abnormality occurs to communicate with the device located within the specific range, and the device specification display is performed by using the display unit of the device located within the specific range. Therefore, on the basis of the device specification display, it becomes possible to easily specify the desired device, for example, the device in which the abnormality occurs from a plurality of devices. Therefore, it is possible to use for managing a system for generating three-dimensional model data using a plurality of imaging apparatuses, a system for acquiring a large number of measurement point data using a plurality of measuring instruments, a system for performing large screen display using a plurality of display apparatuses and the like.

REFERENCE SIGNS LIST

10 System
21-0 to **21-*n*** Imaging apparatus
31 Device management apparatus
41 Network

211 Imaging lens
212 Imaging unit
213 Image signal processing unit
214 Communication unit
215 Display unit
216 Control unit
311 Operation unit
312 Display unit
313 Communication unit
314 Control unit

The invention claimed is:

1. A control apparatus, comprising:

communication circuitry configured to communicate with a plurality of devices to be managed via a communication network; and processing circuitry configured to:

determine positions of the plurality of devices based on absolute position information or relative position information received from the plurality of devices via the communication network;

identify, from the plurality of devices, an abnormal device in which an abnormality occurs;

identify, from the plurality of devices, a set of selected devices located within a region determined based on a position of the abnormal device, the region corresponding to a display pattern that visually indicates the position of the abnormal device; and control, via the communication network, the set of selected devices to perform a device indication process for forming the display pattern that visually indicates the position of the abnormal device, wherein a piece of the absolute position information reported by a first device indicates a position of the first device, and a piece of the relative position information reported by a second device indicates relative positions of neighboring devices with respect to the second device.

2. The control apparatus according to claim 1, wherein the processing circuitry is configured to control light emitting devices of the set of selected devices to perform the device indication process.

3. The control apparatus according to claim 1, wherein the processing circuitry is configured to:

identify, from the plurality of devices, one or more other abnormal devices; and identify the set of selected devices according to the region and one or more other regions corresponding to one or more other display patterns that visually indicate positions of the one or more other abnormal devices, respectively, wherein the region and the one or more other regions do not overlap with one another.

4. The control apparatus according to claim 1, wherein the processing circuitry is configured to perform the device indication process when detecting that the abnormality occurs in the abnormal device on a basis of communication with the abnormal device.

5. The control apparatus according to claim 1, further comprising:

a display device; and a user interface configured to receive a user operation, wherein the processing circuitry is configured to:

control display of icons on the display device, the icons representing the plurality of devices and arranged on a basis of the positions of the plurality of devices; and perform the device indication process in response to detecting that the abnormality occurs in the abnormal device after the abnormal device is instructed to perform a specific operation according to the user operation received by the user interface.

6. The control apparatus according to claim 1, wherein the communication circuitry is configured to communicate with the communication network via a wireless communication or a wired communication.

7. The control apparatus according to claim 1, wherein the processing circuitry is configured to control display of icons on a display device, the icons representing the plurality of devices and arranged on a basis of the positions of the plurality of devices, and the abnormal device being identified by a graphic: in the display of the icons.

8. The control apparatus according to claim 7, wherein the processing circuitry is further configured to control display of device identification information of the plurality of devices in conjunction with the display of the icons.

9. The control apparatus according to claim 7, wherein the processing circuitry is configured to control the display of the icons to render the set of selected devices located within the region determined based on the position of the abnormal device identifiable in the display of the icons.

10. The control apparatus according to claim 9, wherein, in a case where there are one or more other abnormal devices in the plurality of devices and one or more other sets of selected devices for visually indicating positions of the one or more other abnormal devices, respectively, the processing circuitry is configured to change a display attribute of icons representing the set of selected devices for visually indicating the position of the abnormal device.

11. A control method, comprising:

determining, by processing circuitry of a control device, positions of a plurality of devices based on absolute position information or relative position information received from the plurality of devices via a communication network, the plurality of devices being communicatively coupled with the control device via the communication network;

identifying, from the plurality of devices, an abnormal device in which an abnormality occurs;

identifying, from the plurality of devices, a set of selected devices located within a region determined based on a position of the abnormal device, the region corresponding to a display pattern that visually indicates the position of the abnormal device; and controlling, by, the processing circuitry of the control device via the communication network, the set of selected devices to perform a device indication process for forming the display pattern that visually indicates position of the abnormal device, wherein a piece of the absolute position information reported by a first device indicates a position of the first device, and a piece of the relative position information reported by a second device indicates relative positions of neighboring devices with respect to the second device.

12. The control method according to claim 11, further comprising:

controlling light emitting devices of the set of selected devices to perform the device indication process.

13. The control method according to claim 11, further comprising:

controlling, by the processing circuitry of the control device, display of icons on a display device, the icons representing the plurality of devices and arranged on a basis of positions of the plurality of devices, and the abnormal device being identified by a graphic in the display of the icons.

14. A non-transitory computer-readable medium storing instructions which when executed by a computer cause the computer to perform:

determining positions of a plurality of devices based on absolute position information or relative position information received from the plurality of devices via a communication network, the plurality of devices being communicatively coupled with the computer via the communication network;

identifying, from the plurality of devices, an abnormal device in which an abnormality occurs;

identifying, from the plurality of devices, a set of selected devices located within a region determined based on a position of the abnormal device, the region corresponding to a display pattern that visually indicates the position of the abnormal device; and controlling, via the communication network, the set of selected devices to perform a device indication process for forming the display pattern that visually indicates the position of the abnormal device, wherein a piece of the absolute position information reported by a first device indicates a position of the first device, and a piece of the relative position information reported by a second device indicates relative positions of neighboring devices with respect to the second device.

15. The non-transitory computer-readable medium according to claim 14, wherein the instructions when executed by the computer cause the computer to perform:

controlling light emitting devices of the set of selected devices to perform the device indication process.

16. The non-transitory computer-readable medium according to claim 14, wherein the instructions when executed by the computer cause the computer to perform:

controlling display of icons on a display device, the icons representing the plurality of devices and arranged on a basis of positions of the plurality of devices, and the abnormal device being identified by a graphic in the display of the icons.

* * * * *